United States Patent [19]

Knight

[11] 4,286,740

[45] Sep. 1, 1981

[54] APPARATUS FOR ATTACHING A LOAD TO TWO OR MORE BACKPACK FRAMES

[76] Inventor: William E. Knight, 5000 Park Pl., Bethesda, Md. 20016

[21] Appl. No.: 111,682

[22] Filed: Jan. 14, 1980

[51] Int. Cl.[3] ..... A45F 3/10; A61G 1/00

[52] U.S. Cl. ..... 224/157; 5/82 R; 224/158

[58] Field of Search ..... 224/157, 158, 159, 160, 224/161, 265, 266, 153–156, 137; 5/82 R

[56] References Cited

U.S. PATENT DOCUMENTS

| | | | |
|---|---|---|---|
| 620,694 | 3/1899 | Chadwick | 224/157 |
| 3,258,788 | 7/1966 | Anciaux | 224/157 X |
| 3,659,760 | 5/1972 | Blood | 224/210 X |
| 4,087,030 | 5/1978 | Knight | 224/157 |

FOREIGN PATENT DOCUMENTS

| | | | |
|---|---|---|---|
| 479892 | 2/1916 | France | 224/157 |

*Primary Examiner*—Stephen Marcus

*Attorney, Agent, or Firm*—William E. Mouzavires

[57] ABSTRACT

Apparatus consisting of a carrying pole and related equipment capable of releasable attachment on the one hand to frame members of at least two backpack frames worn by human bearers and on the other hand either directly to a load or to a portable carrier in which a patient or goods may be transported. The design affords a high degree of flexibility in carrying loads over difficult terrain with the use of the body's strongest carrying muscles. In different embodiments it may be used with either specialized or standard backpack frames.

2 Claims, 4 Drawing Figures

FIG. 1
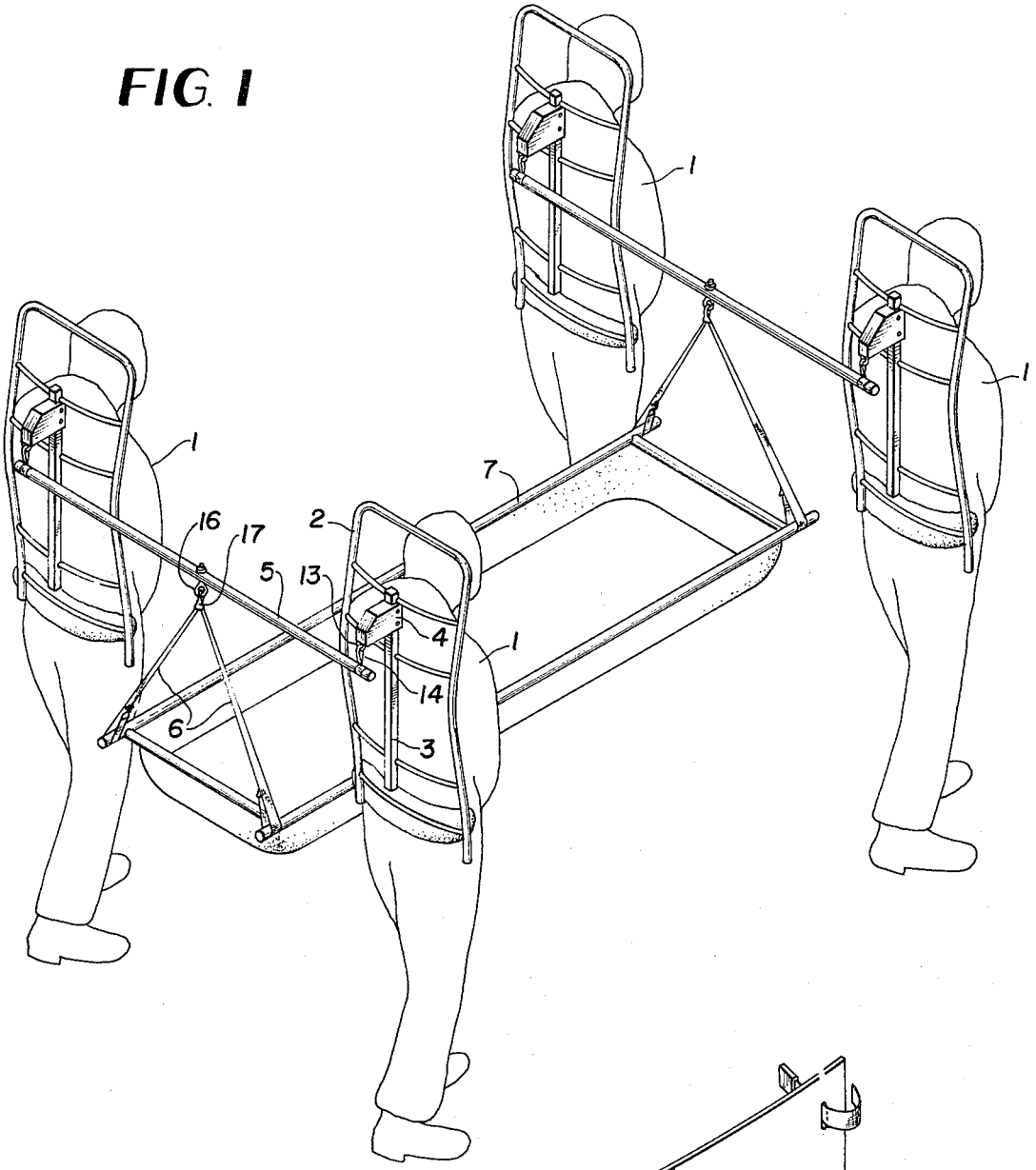
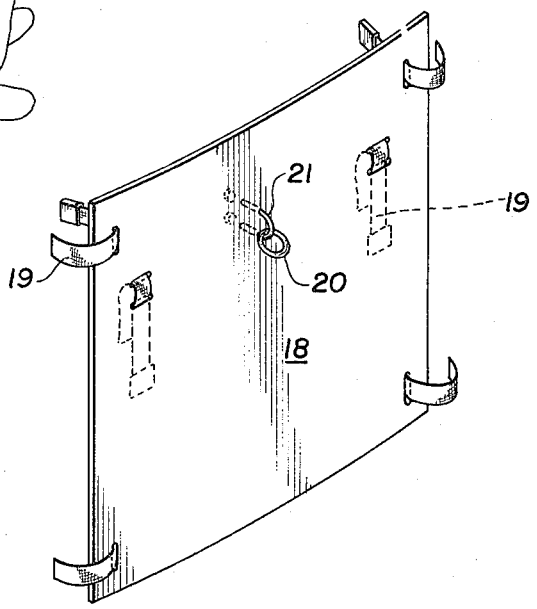
FIG. 3

APPARATUS FOR ATTACHING A LOAD TO TWO OR MORE BACKPACK FRAMES

BACKGROUND OF INVENTION

This invention represents a further advance in the development of apparatus for the transportation over difficult terrain or long distances of a patient or other load through the use of backpack frames worn by two or more human bearers acting in concert. The applicant holds two U.S. patents in this field: No. 4,087,030 dated May 2, 1978 and No. 4,168,793 dated Sept. 25, 1979.

A major shortcoming of previous inventions in this field has been the overall width of the carrying team in using the equipment and the rigidity with which the bearers have been connected to each other and to the load carrier. A primary object of this invention is to provide increased maneuverability to the carrying apparatus to make it easier for the bearer teams to negotiate narrower passages and more difficult terrain. It does this by combining use of backpack frames with a carrying pole flexibly and releasably attached to the frames by a strap or similar means. The pole is also releasably attached by flexible means directly to a load or to the frame members of a litter or load carrier. The load accordingly hangs freely from the pole. This apparatus makes possible a high degree of relative movement between the bearers and the burden in essentially all planes.

A second object is to eliminate the major fluctuations in the relative shares of the burden borne by the various participating bearers caused by the continual changes in the configuration of the trail. Such fluctuations have been an undesirable characteristic of previous rigidly-mounted apparatus.

The third object is to provide adapter means whereby the carrying pole and its associated equipment may be used with non-specialized backpack frames, making unnecessary the purchase of expensive specialized backpack frames.

SUMMARY OF THE INVENTION

This application is directed to the following inventions: improved apparatus for releasably attaching a load or a load carrier to the backpack frames of human bearers who are acting in concert, this being done by means of a carrying pole attached by flexible and releasable means to the load or load carrier on the one hand and to at least two backpack frames on the other; and improved adapter apparatus permitting the attachment of the carrying pole to non-specialized standard backpack frames.

DRAWINGS

FIG. 1 is a perspective view of a litter being carried by four human bearers equipped with the preferred embodiment of the present invention, including the backpack frames, the carrying poles and the carrying straps;

FIG. 3 is a perspective view showing the preferred embodiment of the adapter which is releasably attachable to many standard backpack frames and which makes possible the use of such standard frames in the practice of this load carrying system.

DETAILED DESCRIPTION

Figure 4:
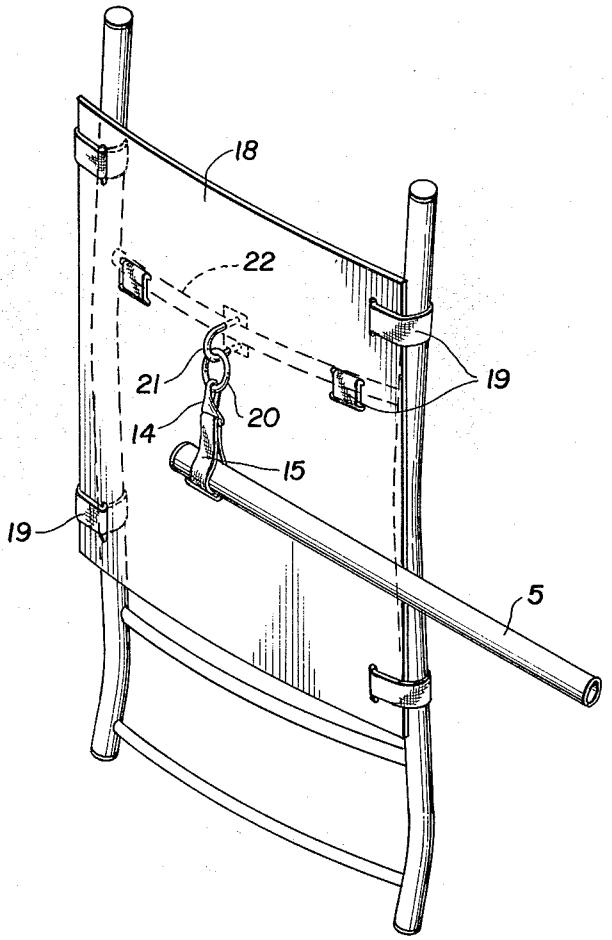
FIG. 4 is a perspective view of the adapter shown in FIG. 3 mounted on a backpack frame, with the carrying pole attached and in operating position.

FIG. 1 is a general undetailed view of a litter being transported by four human bearers as taught in the preferred embodiment of this invention. The bearers are designated 1. They all have the same equipment which for the sake of simplicity is identified by numbers on only one of them. Each bearer is wearing specialized backpack frame 2 which includes as part of its permanent structure a vertical support member of square cross-section, designated 3, extending generally along the longitudinal center line of the frame. Releasably attached to support member 3 is connecting means 4 which is also releasably attached to carrying pole 5. Said carrying pole is in turn releasably attached to main carrying strap 6 which is releasably attached either directly to a load or to the frame members of load carrier or litter 7, as shown.

Figure 2:
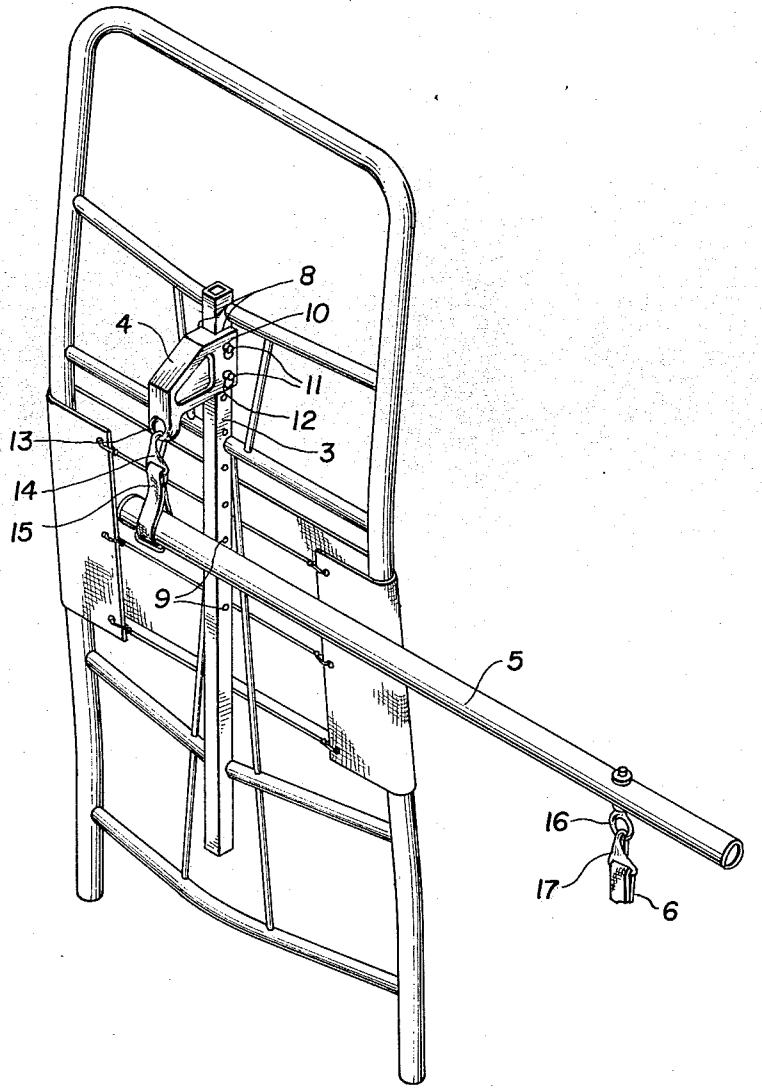
FIG. 2 is an enlarged perspective view of the apparatus shown in FIG. 1 which permits the releasable attachment of the carrying pole to a specialized backpack frame and to a load or load carrier.

FIG. 2 shows details of the apparatus by means of which the carrying pole is releasably attached to the backpack frame and to the litter or load carrier. Connecting means 4 is attached to the backpack frame's support member 3 by means of U-shaped channel 8 which extends along one end of the connecting means and fits snugly over square support member 3. Piercing support member 3 along its lateral axis are uniformly-spaced apertures 9. Apertures of matching diameter and spacing 10 also occur in the U-shaped channel of the connecting means. With the channel placed over the support member, clevis pins 11 are passed through both sets of apertures and secured by split rings 12, the connecting means being thereby held securely to the support member. At the opposite end of connecting means 4 from U-shaped channel 8, the connecting means includes ring 13 extending generally downwards. This ring receives snap hook 14 attached to strap 15 which is non-releasably attached to the end of carrying pole 5. Attached at the center of carrying pole 5 is eyebolt 16, the eye of which extends in a downward direction. This eye receives snap hook 17 at the apex of main carrying strap 6 which divides below the hook into two branches, each of which is releasably attached to the frame members of a litter or load carrier, not shown.

It is to be noted that in the simplest possible version of this invention, straps 15 at the ends of carrying poles 5 could each divide into two separate ends, with one of the ends containing a buckle. This would be in lieu of the snap hook shown in FIG. 2. With such an arrangement, the carrying pole could be releasably attached directly to a horizontal member of any backpack frame. For various operational reasons, this is not, however, the preferred embodiment.

FIG. 3 shows the adapter by means of which non-specialized backpack frames, not specifically made for use with this equipment, may be employed in the practice of this load-carrying system. In this preferred embodiment, a central body portion comprised of shaped panel 18 is so designed that it may be placed against the support members of a backpack frame and firmly yet releasably buckled to these members by means of straps 19. The central body portion could take other forms and other attachments. (Other attachment systems such as clamps could be used within the terms of this invention.) Hanging generally downward from the posterior surface of the panel at approximately the shoulder and neck level of the bearer is a docking means in the form of ring 20, held in place by U-bolt 21 which passes through panel 18 and which may also, on the anterior surface of the panel, be secured to a horizontal member of the backpack frame.

FIG. 4 is a general perspective view of the adapter described in FIG. 3 as it appears in actual operation. Adapter panel 18 is attached by straps 19 and U-bolt 21 to frame members of backpack frame 22. U-bolt 21 further holds docking ring 20 to which is secured snap hook 14 attached to strap 15 which is in turn attached to the end of carrying pole 5.

METHOD OF OPERATION

The method of operation of this equipment is as follows: (1) The patient or other load is placed in the carrier as it rests on the ground; (2) The two ends of each of the main carrying straps to be used are attached to the opposing side frame members of the litter or load carrier; (The number of straps corresponds to the number of pairs of bearers that are to carry at one time.); (3) The bearers team off in pairs by height, the number of pairs depending on the weight of the load, the difficulty of the terrain and the distance of the carry. In most cases, the number of pairs would be two or three; (4) Each bearer dons a backpack frame, either one especially designed for this use or a standard one to which an adapter has been attached, as described above; (5) With the members of each pair of bearers then standing side by side, a carrying pole is attached to their backpack frames by means of the snap hooks at the ends of the pole. The various teams assist each other in this function; (6) The members of each team then take up positions on the opposite sides of the litter in such manner that their carrying pole extends above one of the already-attached main carrying straps; (7) Acting in concert, all bearers lift the litter to a level that permits one member of each pair of bearers to connect a carrying strap by means of its snap hook to the eyebolt in the center of the corresponding carrying pole; (8) The team is then read to move off. The weight rests almost entirely on the bearers' backpack frames, though the bearers typically steady the litter with their hands.

For rest stops, all bearers seize the frame of the load carrier and support its weight while the main carrying straps are unsnapped from the carrying poles. The load carrier is then lowered to the ground.

To switch bearers, it is not necessary to lower the carrier to the ground. With all bearers supporting the weight of the carrier by hand, each bearer can in his or her turn slip out of his backpack frame which can thereupon be donned by a replacement.

It is preferable for a carrying team to have enough sets of this equipment to permit all those carrying at one time to be provided with it. Nevertheless, even a single pair of bearers can use it to good advantage, even if all other members of the team are carrying by hand in the old-fashioned way.

What is claimed is:

1. For use in the transportation of a load by at least two human bearers wearing backpack frames, each of which backpack frames has at least one rigid support member, an adapter comprising a central body portion and means for releasably connecting and positively securing said central body portion to at least one rigid support member of a backpack frame for a human bearer and further comprising docking means to which may be releasably connected a carrying pole for the transportation of a load, whereby the two said human bearers wearing said backpack frames with said adapters attached, and with the adapters further releasably attached to the two opposite ends of said carrying pole, may cooperate in the transportation of a load attached to said carrying pole.

2. For use in the transportation of a load by at least two human bearers acting in concert, in combination with at least two backpack frames each of which has at least one rigid support member, a carrying pole including at each end flexible connecting means for releasably attaching said pole to a rigid support member of a backpack frame along the longitudinal center area of said backpack frame, whereby angular motion in all planes is permitted between each of the two said backpack frames and the pole while the apparatus is in operation, and further including in the center portion of said carrying pole, means fixed to the pole for receiving a flexible support means whereby the pole may be releasably attached to said load or said portable carrier while permitting angular motion in all planes between said load or said carrier and said pole, an adapter comprising a central body portion and means for releasably connecting and positively securing said central body portion to at least one rigid support member of said backpack frame, and further comprising docking means to which may be releasably attached said carrying pole by means of said releasable connecting means forming a part of said carrying pole.

* * * * *